US007430886B2

(12) United States Patent
Zeusnik

(10) Patent No.: US 7,430,886 B2
(45) Date of Patent: Oct. 7, 2008

(54) EASILY MOUNTABLE PAPER MOISTENING DEVICE

(76) Inventor: Joachim Zeusnik, Lohnergartenstrasse 19a, Südlohn (DE) 46354

( * ) Notice: Subject to any disclaimer, the term of this patent is extended or adjusted under 35 U.S.C. 154(b) by 125 days.

(21) Appl. No.: 10/592,644

(22) PCT Filed: Mar. 11, 2005

(86) PCT No.: PCT/DE2005/000454

§ 371 (c)(1),
(2), (4) Date: Sep. 13, 2006

(87) PCT Pub. No.: WO2005/087069

PCT Pub. Date: Sep. 22, 2005

(65) Prior Publication Data

US 2007/0144428 A1 Jun. 28, 2007

(30) Foreign Application Priority Data

Mar. 13, 2004 (DE) ..... 10 2004 012 404
Sep. 15, 2004 (DE) ..... 10 2004 044 566

(51) Int. Cl.
*B08B 3/04* (2006.01)
*B05C 11/02* (2006.01)
*D06B 1/00* (2006.01)
*D06B 1/14* (2006.01)

(52) U.S. Cl. ..... 68/205 R; 118/264; 134/84

(58) Field of Classification Search ..... 134/84; 118/264

See application file for complete search history.

(56) References Cited

U.S. PATENT DOCUMENTS

| | | | | |
|---|---|---|---|---|
| 2,308,168 | A * | 1/1943 | Garson | 118/419 |
| 3,837,595 | A * | 9/1974 | Boone | 242/594.5 |
| 4,106,433 | A * | 8/1978 | Fernando et al. | 118/212 |
| 4,747,365 | A * | 5/1988 | Tusch | 118/221 |
| 5,966,772 | A * | 10/1999 | Woodnorth et al. | 15/230.11 |
| 6,319,318 | B1 * | 11/2001 | Pekarek et al. | 118/249 |
| 6,382,552 | B1 * | 5/2002 | Paul et al. | 242/595 |
| 7,056,385 | B2 * | 6/2006 | Likosar | 118/249 |
| 2003/0101681 | A1 * | 6/2003 | Tychsen | 52/783.1 |

* cited by examiner

*Primary Examiner*—Frankie L. Stinson
*Assistant Examiner*—Samuel A Waldbaum
(74) *Attorney, Agent, or Firm*—James Creighton Wray; Clifford D. Hyra

(57) ABSTRACT

The invention relates to an easy mountable paper moistening device (1) comprising two structural units (17, 18). One of the units consists of a roller (3) which supports the cleaning paper (2), said roller being connected to the room wall (12), and the other unit is connected in a separated manner to the housing (8) which comprises a tank (9) and a moistening roller (10) in addition to a conductor element (11), which is also connected in a separated manner to the room wall (12). The two-part housing (8) can be easily connected to the room wall (12) and in the respectively correct position, whereby distancing hooks (21, 22) are arranged as an aid. The individually connected sheets (4, 5, 6) can be guided by the conductor element (11) either over the moistening roller (10) or on the moistening roller (10), in order to dry or moisten the user. Said type of housing (8) can easily be associated, in retrospect, with a roller (3) and represents an optimal paper moistening device (1).

28 Claims, 8 Drawing Sheets

14
15
16
33
49
50
46
45'
10
47
51
20
46'
32
19,25
31
30
61
62
64
60
45

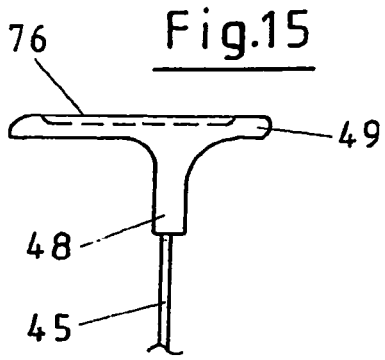
Fig.15
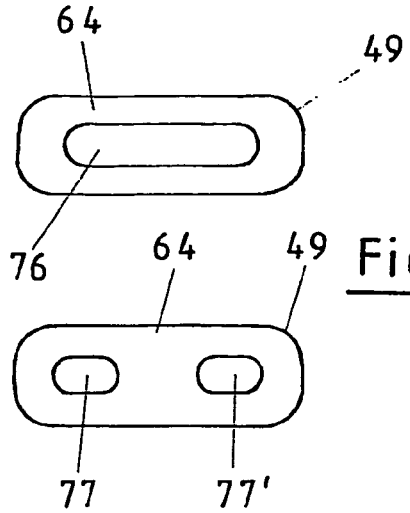
Fig.16
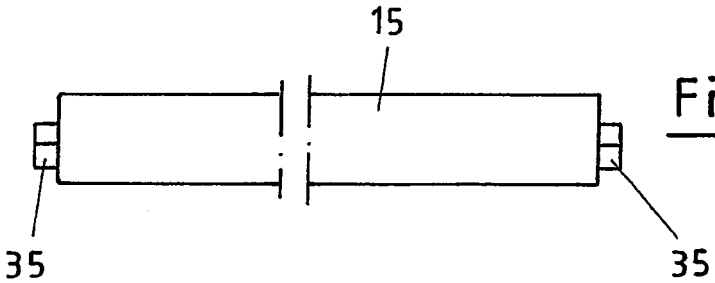
Fig.17
Fig.18
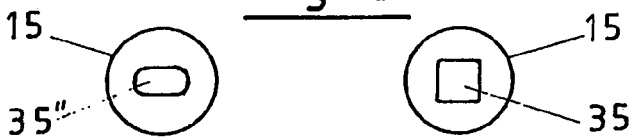
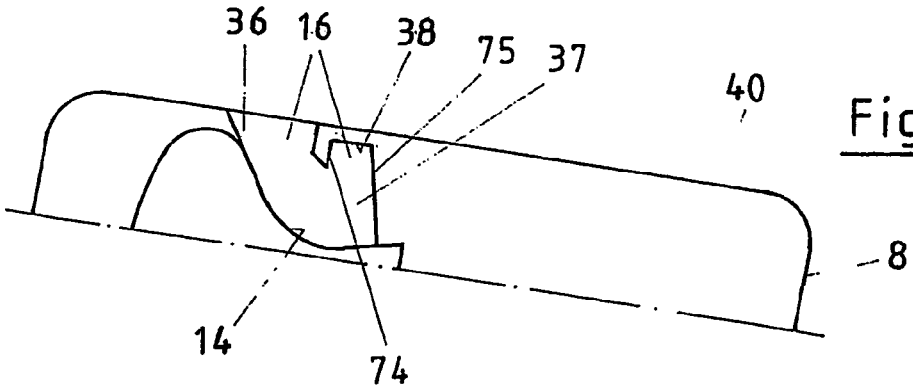
Fig.19

EASILY MOUNTABLE PAPER MOISTENING DEVICE

This application claims the benefit of German Application No. 10 2004 012 404.3 filed Mar. 13, 2004, German Application No. 10 2004 044 566.4 and PCT/DE2005/000454 filed Mar. 11, 2005, which are hereby incorporated by reference in their entirety.

BACKGROUND OF THE INVENTION

The invention relates to a paper moistening device for the storage and specific dispensing of dry or moistened cleaning paper, which device consists of detachably connected sheets stored on a roller, which sheets can move with or without the moistening roller associated with a tank over said roller, whereby the rotatable moistening roller and the conductor elements guiding the sheets are associated with a housing that can be connected to a room wall.

Paper moistening devices of this type are known as toilet tissue moistening devices in various versions (DE-OS 42 43 408, DBP 100 60 993, DE-OS 28 28 163, U.S. Pat. No. 3,800,494, DE-GM 77 15 417 and DE-PS 196 30 686). All afore-mentioned paper moistening devices share the fact that the moistening of the individual papers and/or sheets is not always guaranteed by the moistening rollers, that the entire paper moistening device has a complex housing design, and that it is difficult to tear off the individual sheets. Similar circumstances exist for DE-OS 26 44 871, DE-GM 76 37 181, FR-A 2 128 210 and FR-A 2 722 384. These solutions also basically share the characteristic, that the moistened, or also the non-moistened, individual sheet has to be separated from the subsequent sheet and that the penultimate sheet has to be so held down, that the last sheet can be torn off. DE-OS 199 58 752 also offers a solution in which the individual sheet is unwound from the roller, is then guided across the moistening roller or held away from it by spring-like elements, in order that it can be torn off after leaving the housing by holding the penultimate sheet down. Here, too, a complicated and complex housing is depicted, which accepts the roller with the cleaning paper and contains the tank with the moistening roller and the optionally required conductor elements, which in this case, however, have been constructed as tear-off aids. As the individual sheets, which are still connected, are guided through, the sheets are kept away from the moistening roller by conductor elements referred to as spring elements, or they are pulled down on these elements after overcoming the spring force. The disadvantage, in addition to the linear moistening of the sheet, is the compact design of the housing, which is associated with the necessity for the user to replace the previously used cleaning device with the new one containing the paper moistening device. In the end, all this is associated with expenses, including for the manufacture, which affects the price of these paper moistening devices. Particularly sick people, however, are dependent on such moist cleaning papers, meaning toilet tissue.

SUMMARY OF THE INVENTION

It is therefore the object of the invention to create a paper moistening device, particularly for toilet tissue, that has a simple design and that at the same time can be mounted securely and is easy to install and handle.

The object is achieved through the invention in that the housing is arranged on a room wall at a defined distance to the roller with the sheets and that a stationary, funnel-shaped insertion trough and a deflection rod arranged therein, which rod is secured against accidental removal and is guided in a slot-shaped recess allowing substantially vertical movements, are provided as the conductor elements, between which the attached sheets can be moved towards the moistening roller.

On a paper moistening device of this type, the roller with the individual sheets and the components comprising the moistening elements and/or the moistening roller are not necessarily configured as a unit, but instead the user has the freedom of arranging the housing relative to the roller. Yet, the cleaning paper in the form of the connected sheets is securely guided through the housing and then over the moistening roller in such a manner that an even and reliable moistening is possible. This is achieved with the conductor elements configured as the stationary funnel-shaped insertion trough on the one hand and the deflection rod rotatable therein on the other hand, which rod can perform limited vertical movements, so that the insertion angle of the sheets into these conductor elements can be varied as needed. The same applies to the process of pulling and/or guiding the sheets out, which are conducted either flat over the moistening roller so as to moisten them or upward at a slight angle so as to use them in the dry state. It is thereby advantageous that the housing with the conductor elements can be so positioned either above or below the roller, as the circumstances require or allow, that the most favorable position results for the user at all times. Furthermore, this particular design offers the possibility of providing an easily mountable paper moistening device, which as a lightweight component can be positioned in the prescribed position above or below the roller. Finally, it is advantageous, that the required conductor elements, which are used to securely guide the paper and/or the individual sheets, are extremely simple and at the same time easy to handle because the stationary funnel-shaped insertion trough and the corresponding deflection rod guarantee secure guidance either on the moistening roller or over the moistening roller.

According to a useful variation of the invention, it is envisioned that the roller with the sheets is configured as a unit that is fastened above or below the housing and independently thereof is connected to a room wall, while the housing with the conductor elements and the moistening roller represents an additional unit. As already mentioned above, this offers several advantages; primarily that the roller and the housing are provided as separate units and can be installed as such. This creates the possibility of optimally utilizing the available space and at the same time the components are much easier to install. Above all, it is also possible to successively associate the appropriate paper moistening device and/or the housing with an already exiting and mounted roller, and both units are much easier and cost-effective to produce.

So as to allow easier installation of the housing with the conductor elements, it is envisioned that the housing is configured as two parts and comprises a wall fastening part and a tank part with the conductor elements, the tank and the moistening roller. First, the wall fastening part is connected to the room wall, which can be easily carried out with the necessary accuracy due to the simple configuration, in order that the tank part with the conductor elements, the tank and the moistening roller in turn are connected to the wall fastening part in the most suitable fashion. Both parts then form a unit, which is correspondingly positioned with respect to the roller and functions accordingly.

The installation of the housing, and thus the wall fastening part, is facilitated in that the wall fastening part is associated with distancing hooks that can be attached to the roller, which hooks are detachably connected to the wall fastening part and thus offer the possibility of attaching the entire wall fastening part to the premounted roller in a simple manner, ensuring that the wall fastening part is always optimally connected to the room wall and ensures the function of the entire paper moistening device. Following the installation of the wall fastening part, the distancing hooks are removed and the tank part is attached in order to be able to put the entire paper moistening device into operation.

The installation, or the connection, of the wall fastening part to the roller is facilitated in that the distancing hooks are configured such that they can be hinged in the rotational axis of the roller. Due to the fact that two distancing hooks arranged at a distance from each other are used, not only is the correct distance between the wall fastening part and the roller created, but in addition the components and/or parts are parallel to each other. Furthermore, following the installation of the wall fastening part, the individual distancing hooks can be removed without difficulty and stored for other purposes or simply be disposed of.

Reference has already been made above that, following the installation of the wall fastening part, the wall fastening part and tank part can be easily connected, whereby the invention envisions that the wall fastening part includes support arms, which at the same time fix the tank part in place. Accordingly, the tank part can basically be placed on the support arms of the wall fastening part and effectively be connected thereto, so that other additional assembly work is eliminated.

This simplified assembly and/or connection of the wall fastening part and tank part benefits in particular from the fact that according to the invention the support arms and the support part comprise matching tongue-and-groove connections. In the configuration previously described and the arrangement of the tongue-and-groove connection, the necessary connection between the wall fastening part and tank part can easily be established, meaning by simply placing the tank part on the support arms. Appropriate final guiding on the support arms ensures that the tank part is not accidentally folded up. The entire connection between the tank part and the wall fastening part, however, becomes particularly secure in that the tongue is provided with a lateral catch point and the groove with a corresponding catch groove. As a result the two parts can only be consciously disassembled, whereby upon engagement the user easily recognizes from the "clicking sound" that the two parts have been securely connected.

Optimal guidance of the individual sheets, which occurs with them attached between the trough and the deflector rod, is achieved when the insertion trough, viewed from the room wall side, manifests a flatter insertion taper, the actual trough and then a steeper removal taper to the opposite side. As a result, the cleaning paper is first guided specifically into the insertion through and then into the actual trough and it is hereby pushed into the trough by the deflection rod so that the removal is performed in a specific manner, to be sure over the moistening roller, if no load is applied on the deflection rod, and over the moistening roller without moistening of the individual sheets, if the deflection rod is lifted. It has proven to be advantageous, if the insertion taper has an incline of 20 to 60° and the steeper removal taper an incline of 70 to 85°. The removal taper is therefore steeper, whereby, depending on the position of the roller with the individual sheets, the individual angles can also lie more closely together, meaning that also the insertion taper can be slightly steeper, which is particularly advantageous, when the individual sheets are fed from above.

The deflection rod should be guided securely in the slot-shaped recess, even if the individual sheet is accidentally pulled from the conductor elements at too steep an angle. This is achieved in that the deflection rod manifests on the ends rod ends that are guided in the slot-shaped recesses, which has a diameter that corresponds to the width of the insertion opening of the slot-shaped recess. Since the slot-shaped recess is arranged such that the deflection rod is secured against being lifted out, an appropriate position can be easily achieved. The unintentional removal of the deflection rod from the slot-shaped recess is made more difficult and/or largely prevented in that the deflection rod is positioned torsionally secured in a guide chamber, whereby the rod ends are preferably configured in a non-circular or polygonal, particularly square, manner. Accordingly when subjected to an appropriate load, the deflection rod slips into the corresponding guide chamber and is set and then fixed in place such that the resistance, or better, the friction is still sufficiently high, when the last sheet is pulled off the roller over the moistening roller. It has proven to be optimal, if the deflection rod is fixed such that it can no longer rotate at all because then the transmission of the necessary friction is always guaranteed.

A further optimization of the guidance and/or safeguarding against accidental removal is accomplished, when the slot-shaped recess is configured as a double funnel, which consists of an insertion opening that is open at the top and a guide chamber connected thereto, which is open at the top and closed at the bottom. This guarantees that during insertion of the deflection rod in the insertion opening, meaning into the first part of the double funnel, the rod drops so far down, that if the deflection rod is raised during renewed lifting, for example when pulling up the guided or jammed sheet, that it moves into the connected guide chamber, which is open at the bottom and closed at the top, and is then located in this guide chamber with its rod ends, thus securely preventing removal by the guided sheets.

The accidental removal of the deflection rod and its fixing in the guide chamber is additionally secured in that the roof of the guide chamber is configured at a slight incline away from the room wall side, preferably even extending upwardly at an angle, while the guide tapers create a funnel leading up to the roof, which on the end is adapted to the shape of the rod ends. With a square configuration of the rod ends, the roof therefore has a level progression; with a non-circular configuration, for example an oval configuration, of the rod ends it has a correspondingly arched progression, so that the rod ends are virtually embedded in the guide chamber. As a result this prevents removal, but at the same time also guarantees the desired and secure fixation of the deflection rod. As a result, secure guiding is guaranteed all the way to the last sheet.

By pulling the cleaning paper and/or the individual sheets, also the moistening roller has to be rotated. The necessary smoothness is guaranteed when, as is provided according to the invention, the tank of the tank part manifests a funnel-shaped recess on each inside of the side walls, in which recess the axis of the moistening roller is rotatably fixed. The moistening roller can therefore be inserted in the tank from above and automatically slides into the funnel-shaped recess, and hence into a position in which it can be easily pulled through the water or other liquid stored in the tank. The arrangement and also a variant of the deflection rod mentioned later, guarantee secure usage of the moistening roller by the paper and/or the sheets moving across it, since the rod ensures that the moistening roller is applied all the way to the last sheet due to the corresponding friction in the area of the deflection rod. The usage of the moistening roller also guarantees that the individual moistening shoes can ensure an even moistening of each respective sheet.

Surprisingly, it is possible to specifically moisten the individual sheets and no longer bring them in contact with water more or less accidentally when, as is provided according to the invention, the moistening roller manifests support disks disposed at a distance from each other, which disks are provided on the outer edges with moistening shoes and in the center with a hollow shaft, which can be slid onto the axis. Consequently, no arbitrary compact rollers with large surfaces serve the moistening, but rather a plurality of more or less small moistening shoes, which are arranged on the outside of the support disks. These support disks are disposed and configured such that they can be pulled through the tank and the liquid contained therein without creating a lot of resistance and without absorbing a lot of water, whereby water can be applied to the moistening shoes practically only on the surfaces thereof, which water is then transferred during rotation to the individual sheets. These individual support disks are slid onto the shaft so that the moistening width can be influenced accordingly, wherein of course more compact moistening rollers are conceivable, with only the exception that then the resistance as well as the amount of water that is absorbed may increase while passing through the water reservoir, which may result in uneven moistening. With the execution model described here, it is particularly important, that only the surface of the moistening shoes transfers water and/or liquid onto the individual sheet, so that a very specific and exact moistening of the respective sheet is guaranteed.

For the configuration with the hollow shafts it is particularly advantageous if the hollow shafts of the support disks are designed such that they can be connected securely to the adjacent hollow shafts, so that a complete unit can be produced, which ensures that the individual support disks can be rotated at the same speed or that the rotation cannot be prevented.

It was already pointed out above that the configuration of the support disks connected to each other offers the advantage, that the working width of the moistening roller can be adjusted. According to another variation, it is envisioned that the support disks with the moistening shoes are positioned on both sides of a drying edge for the sheets while on the shaft or that the outer support disks are positioned at a defined distance to the side walls. This demonstrates that it guaranteed in this useful manner, that the individual sheets do not tear anywhere in the center, but in every case cross over the moistening roller and are then available for further handling.

The greatest possible equal moistening is further guaranteed in that the moistening shoes are connected to the support disks offset from the center and alternate to both sides. This produces a very even moistening pattern, a very useful variant which will be addressed further below. In order to guarantee a suitable moistening only across the surface of the moistening shoes that was mentioned above, it is envisioned, that the moistening shoes are connected to the support disk via a bar that is dimensioned in accordance with the width of the support disk. The water or the moistening liquid is thus directed away from the bottom of the moistening shoe, or stated otherwise, it is prevented, that too much liquid is supplied from beneath up to the moistening shoes, because the contact surface is also minimized by the bar.

Another useful variant of the moistening shoes is one in which it manifests rounded or sharpened edges, in order to ensure a specific moistening of the surface of the moistening shoes. In a particularly suitable version, the moistening shoes manifest a hull-like design in the direction of movement. In the process the liquid is quasi-intersected and thus suitably supplied to the moistening shoes and/or the surface of the moistening shoes, which ensures a continued equal moistening of the individual sheets. In this way or, as the case may, by the shape of the moistening shoes it occurs, that non-needed liquid is not carried along and attached to the moistening shoe.

A specific carrying along of the liquid is above all guaranteed by the moistening shoes being made of rubber-like and/or rubber material (PE+rubber) and/or manifesting one or more concave impressions in their surfaces. While the remaining parts of the moistening shoes are configured more or less smoothly, this special surface and the selection of the material assures a secure adhesion of the moisture. As a result of the concave impressions in the surfaces of the moistening shoes, a certain quantity is defined, which the individual moistening shoes carry with them and then transfer to the sheet sliding across. While the dry regions are maintained, a specific and, in the end, variable moistening of the individual sheets is thus guaranteed, which advantageously increases the success of cleaning and also the acceptance. Due to the friction that is created, the rubber material ensures a reliable entrainment of the moistening roller and a simultaneous moistening of the sheets.

In order not to have to replace the entire moistening roller, when other circumstances require that, the invention envisions that the moistening shoes and/or the bars are detachably connected to the support disks, preferably insertable into bored holes of the support disk or are configured such that they can be placed on the support disks. This offers the possibility of removing the moistening shoes with the bars, or also only the moistening shoes, and replace them with larger ones, smaller ones or also ones with different shapes, in order to vary the moistening pattern on the individual sheets and/or adapt them to the circumstances. At the same time, the moistening level of the sheets is varied, depending on what direction the user desires. Of course it is also possible to replace the complete moistening rollers.

It was previously mentioned, that the moistening shoes are constructed with a hull-like configuration in the direction of movement. According to another execution model, however, the moistening shoes may also be configured in a tapered fashion all the way around in a hull-like design so as to achieve in this manner the specific moistening of the surfaces of the individual moistening shoes.

The moistening pattern "magically" created by the moistening shoes on the respective sheet is particularly effective and advantageous, if the moistening shoes are configured or arranged in a honeycomb-like manner. This means that small dry zones can be found between the correspondingly larger moistening surfaces. The honeycomb-like configuration is therefore advantageous because it guarantees sufficient stability for each sheet, even when moistened.

It is particularly advantageous if the moistening shoes are designed like large honeycomb walls, while leaving small dry zones in between them. The honeycomb walls therefore produce zigzag-shaped small dry zones which, as mentioned above, produce optimal stability for the entire sheet, which the user can pull off and use without difficulty even in a moist state.

It has proven useful if the dry zones have widths of 0.5 to 5.0 mm, preferably 2.0 mm. The remaining bars or, better stated, the dry zones are then sufficiently large to provide the entire sheet with the necessary tensile strength, whereby the moist zones are optimally sized and also are very user-friendly, because they represent an optimally large area distributed across the sheet.

The deflection rod functioning as a conductor element ensures, that the attached sheets are pulled securely through the paper moistening device, which is even possible when the roller holding the cleaning paper has been either almost or completely used up. For this purpose, the invention additionally provides that the deflection rod has a rough surface or an appropriate coating or that it is made of the same material as the moistening shoes. The rod then offers appropriate resistance and/or produces the necessary friction, which ensures that even the last sheet can be pulled over the moistening roller while carrying said roller along.

This is aided and supported by the fact that the deflection rod, as was explained above, has been fixed in place so that it cannot rotate as the individual sheets are pulled through, but instead always ensures the necessary friction.

The invention is particularly thereby characterized by a paper moistening device is created, which is particularly easy and suitable to install, even after the fact, which means it can be associated with already existing cleaning paper rollers. The only thing required is to arrange the base of the housing, which advantageously is made in two parts, at a certain distance to the roller, which distance is defined by aids, either above or below the roller depending on the available installation space. Thereafter the two parts, namely the roller and the housing with the conductor elements, can interact with each other and in such a way, that an optimal moistening of the individual sheets is guaranteed but there is also the possibility of pulling the individual sheets in a dry state over the moistening roller without the conductor elements moving out of their functional position. In addition to the easy installation, the inexpensive design is also advantageous because both the actual housing with the wall fastening part and the tank part, and also in particular the moistening roller, have a shape and configuration which clearly deviate from those in the state of technology and contribute to the provision of an inexpensive paper moistening device, which furthermore has optimal functional characteristics.

Additional details and advantages of the invention will be apparent from the description of the following drawings which illustrate a preferred execution model with the necessary details and individual parts. Shown are:

DETAILED DESCRIPTION OF THE PREFERRED EMBODIMENTS

Figure 1:
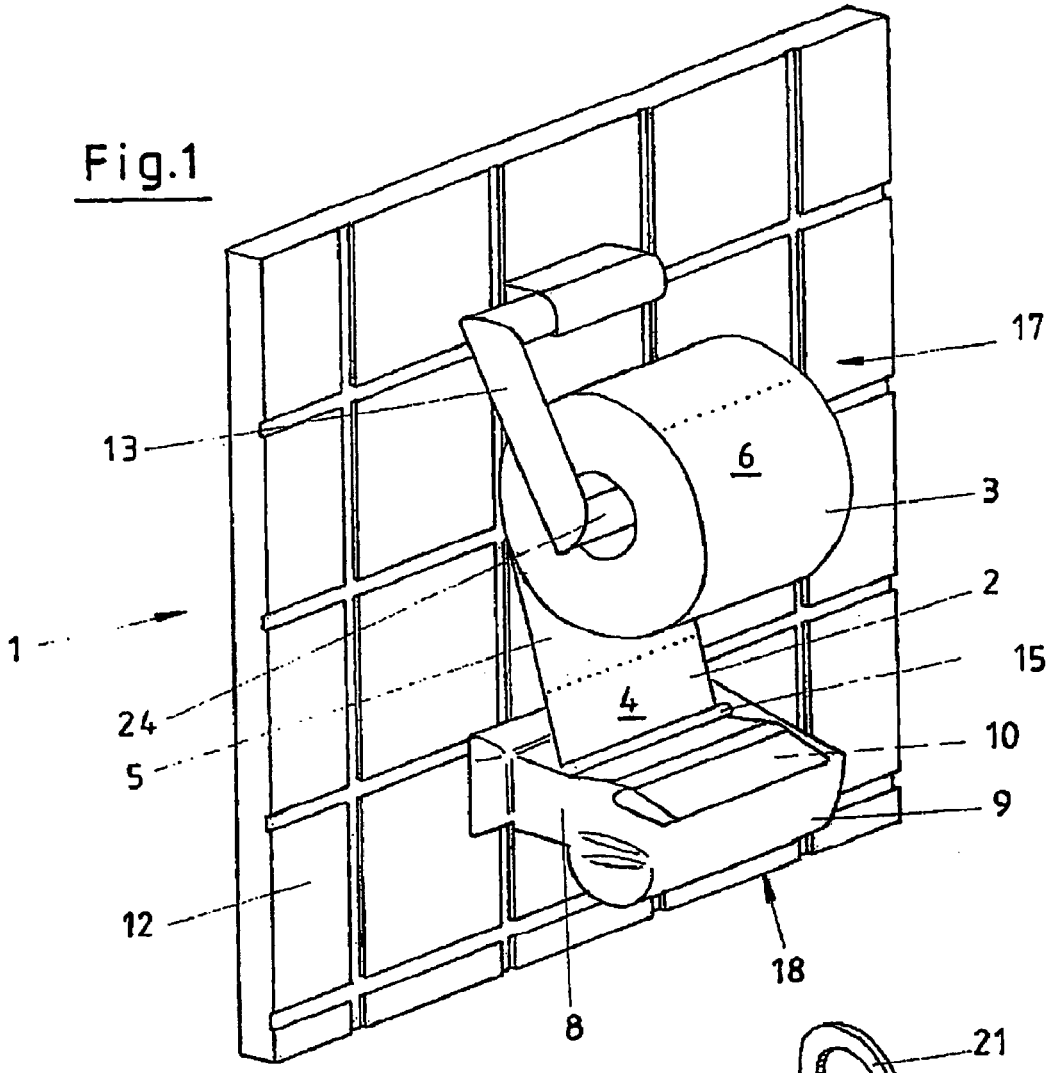
FIG. 1 A functional unit of the roller and housing, namely a paper moistening device combination in the operating position, FIG. 2 An installation unit for the subsequent attachment of the actual paper moistening device, FIG. 3 A side view of a wall fastening part of the housing, FIG. 4 A side view of the tank part of the housing, FIG. 5 A top view in perspective of the housing with the moistening roller, FIG. 6 Side and top views of a moistening shoe, which represents one part of the moistening roller, FIG. 7 A sectional view of a moistening shoe and a bar supporting a moistening shoe, FIG. 8 Top view of a moistening roller with moistening shoes, which are shown only in part, FIG. 9 Top view of the deflection rod, FIG. 10 Side wall of the tank part with a slot-shaped recess for guiding the deflection rod, FIG. 11 Front overhead view of the moistening roller, FIG. 12 Side view of an individual support disk of the moistening roller, FIG. 13 Side view of the shaft of the moistening roller, FIG. 14 Individual sheet of the cleaning paper in the moistened state, FIG. 15 Side view of a moistening shoe with an impression, FIG. 16 Top view of such a moistening shoe with an impression or two impressions, FIG. 17 Side view of a deflection rod with non-circular rod ends, FIG. 18 Top front view of a deflection rod with an oval rod end or a square rod end, FIG. 19 Inside of a side wall of the tank part with a special slot-shaped recess, FIG. 20 Side view of the support arm with a continuous tongue, and FIG. 21 Top view of this support arm with tongue as well as bottom view of the fitting part with continuous groove.

FIG. 1 illustrates a paper moistening device 1, which is connected to a room wall 12. This paper moistening device 1 consists of a roller 3 holding the cleaning paper 2. The cleaning paper 2 consists of a previously determined quantity of connected sheets 4, 5, 6. FIG. 1 shows a toilet tissue roller consisting of such individual sheets 4, 5, 6.

Shown below this roller 3, which represents one construction unit 17, is the housing 8, representing another unit 18 together with its conductor elements 11 and the moistening roller 10. This unit 18 is also connected to the room wall 12, which will be explained in more detail later. This housing 8 includes a tank 9, in which the moistening roller 10 is rotatably disposed. The cleaning paper 2, meaning the individual sheets 4, 5, 6, is so guided by the conductor elements 11, that they either come in contact with the moistening roller 10 and are thus moistened or are instead pulled dry over said roller.

Figure 2:
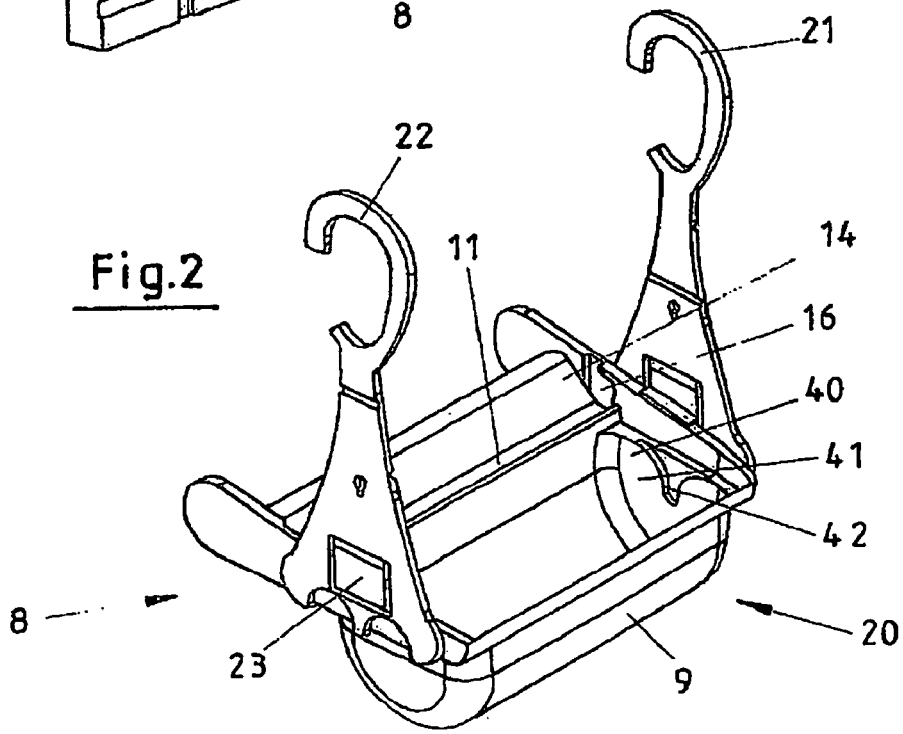

FIG. 2 shows a part of the housing 8 in an enlarged view, specifically the tank part 20. This tank part 20, which is also shown in a side view in FIG. 4, is connected to the room wall 12 as one unit together with the wall fastening part 19 shown in FIG. 3. This unit is connected to the axis of rotation 24 of the roller 3 with the help of the distancing hooks 21, 22, which are connected via clamps 23 to the tank part 20 or also the wall fastening part 19, or in other words, this unit is engaged therein by means of the distancing hooks 21, 22. The figure shows, that the roller 3 is rotatably disposed on this axis of rotation 24, whereby the axis of rotation 24 is fixed to the room wall 12 via the wall retainer 13. It can be recognized that the roller 3 together with the additional parts forms one unit 17, which is fastened to the room wall 12 independently of the housing 8. The paper and/or the sheets 4, 5, 6 are guided off the roller 3 and are then pulled beneath the deflection rod 15 across the funnel-shape insertion trough, whereby the deflection rod 15 is positioned with limited displaceability in a vertical direction in the slot-shaped recess 16 shown in FIG. 2. The deflection rod ensures 15 that the guidance of the cleaning paper 2 is maintained, even when pulling out the cleaning paper 2 without contact to the moistening roller 10 and then during moistening, i.e., as it is pulled over the moistening roller 10, it promptly resumes the correct position and can be effectively moistened.

Figure 3:
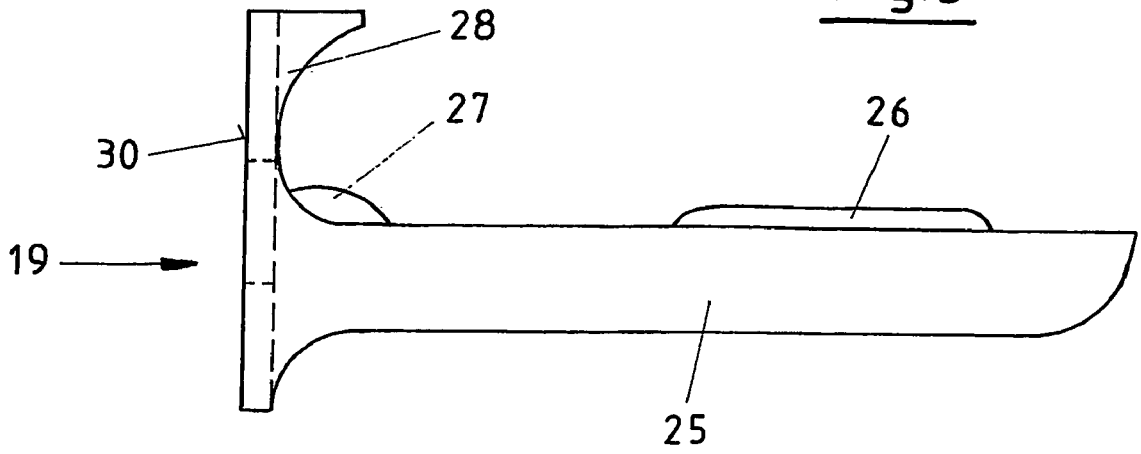
Figure 4:
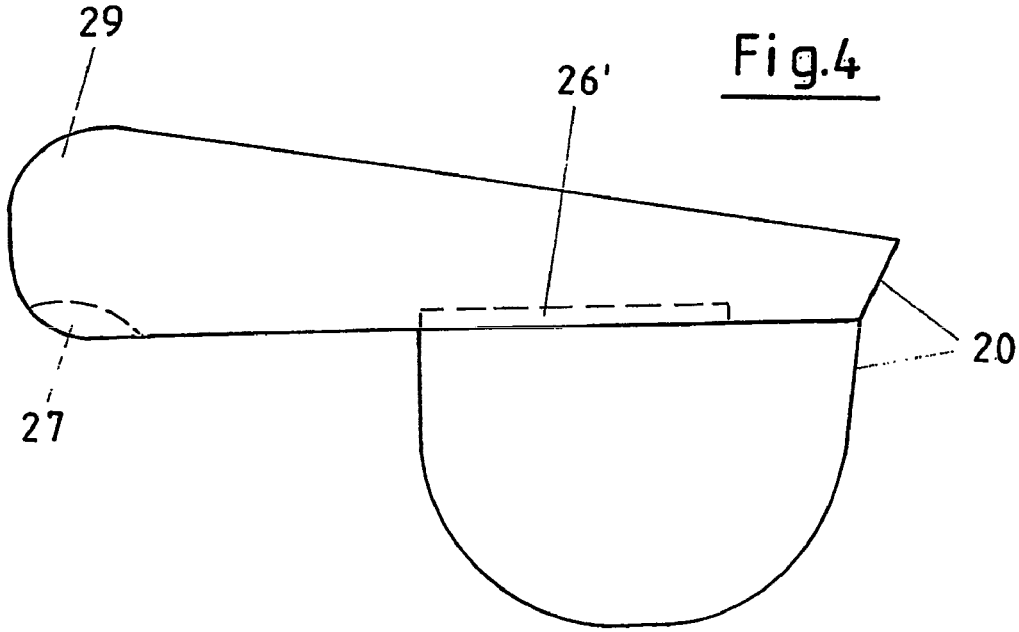

FIGS. 3 and 4 illustrate the wall fastening part 19 and the tank part 20 and the connecting areas thereof. For this purpose, the wall fastening part 19 is provided with support arms 25, which are equipped with tongue-and-groove connections 26, 27 that correspond to the groove connections of the tank part 20. Moreover, the wall fastening part 19 has a catch retainer 28, into which the fitted part 29 of the tank part 20 is inserted, so as to ensure an effective connection via the tongue-and-groove connections 26, 27. The tongue connections have been marked with reference numerals 26, 27 and the groove connections with 26', 27'.

Figures 5, 6, 7:
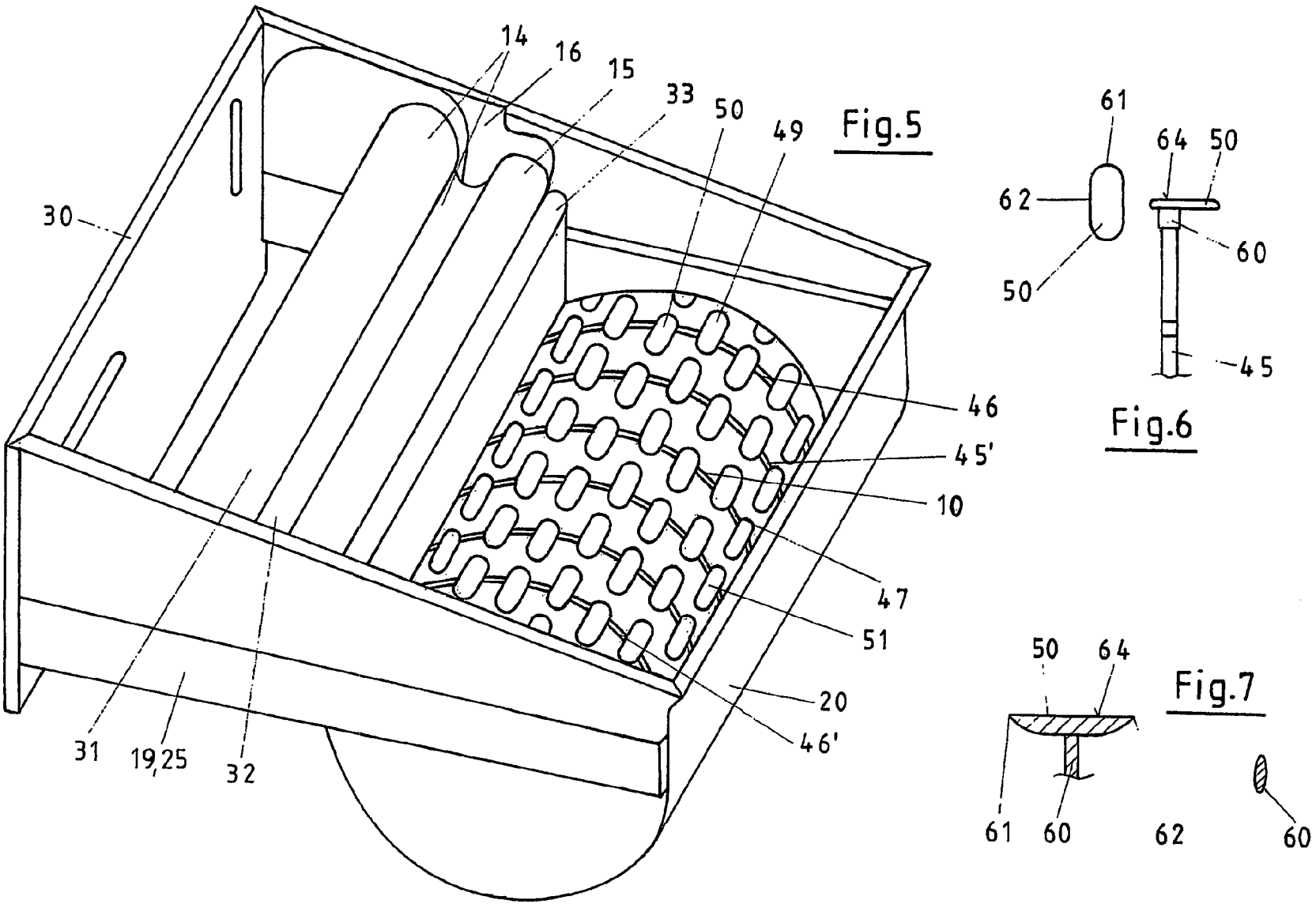

FIG. 5 shows an illustration in perspective and a top view of the housing 8. Here the funnel-shaped insertion trough 14, the deflection rod 15 and the slot-shaped recess 16, in which the deflection rod 15 is positioned so as to move up and down, can be seen. The paper and/or the individual sheets 4, 5, 6 are not shown, in order to make the details, particularly regarding the moistening roller 10, more clear. The unit comprising the wall fastening part 19 and tank part 20 is connected to the room wall 12 on the room wall side 30. Also recognizable here and as will be also shown in FIG. 10, the funnel-shaped insertion trough 14 consists of the flat insertion taper 31 and the actual trough 32 as well as the steeper removal taper 33. This allows specific guiding of the sheets 4, 5, 6, in such a manner, that the deflection rod 15 has limited vertical up and down movement.

The special configuration of the moistening roller 10 with the support disks 45, 46, 47 and the moistening shoes 49, 50, 51 will be addressed further below. At any rate, the flat insertion taper 31, the trough 32 and the steeper removal taper 33 ensure a useful and suitably defined guidance of the sheets 4, 5, 6 across the moistening roller 10 in such a way, that the sheets 4, 5, 6 either remain dry or are moistened.

FIG. 6 shows a side view of a support disk 45 with the moistening shoe 50 placed on top. Its surface has been designated as 64. It can be smooth or rough, which is not apparent from the second view, which is the top view. This illustration, however, shows that the shape of the moistening shoes 49, 50, 51 is oval or hull-like, which is also illustrated particularly well in FIG. 7. Reference numeral 60 designates the bar, on top of which the moistening shoe 50 is placed or arranged.

FIG. 7 shows such a moistening shoe 50 in a sectional view, whereby it can be seen, that both edges 61, 62 are sharpened or have a hull-like design. This prevents the carrying along of water and facilitates the immersion into the water and/or the liquid, without carrying along smears, droplets or the like. Additionally, the respective bar 60 is so cut as illustrated in the image on the right side.

Figure 8:
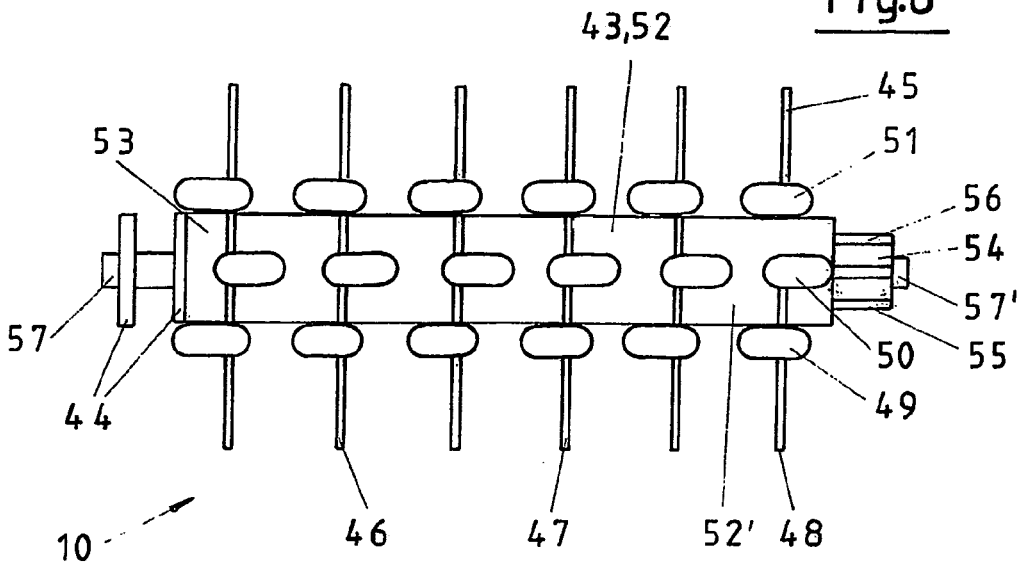
Figure 14:
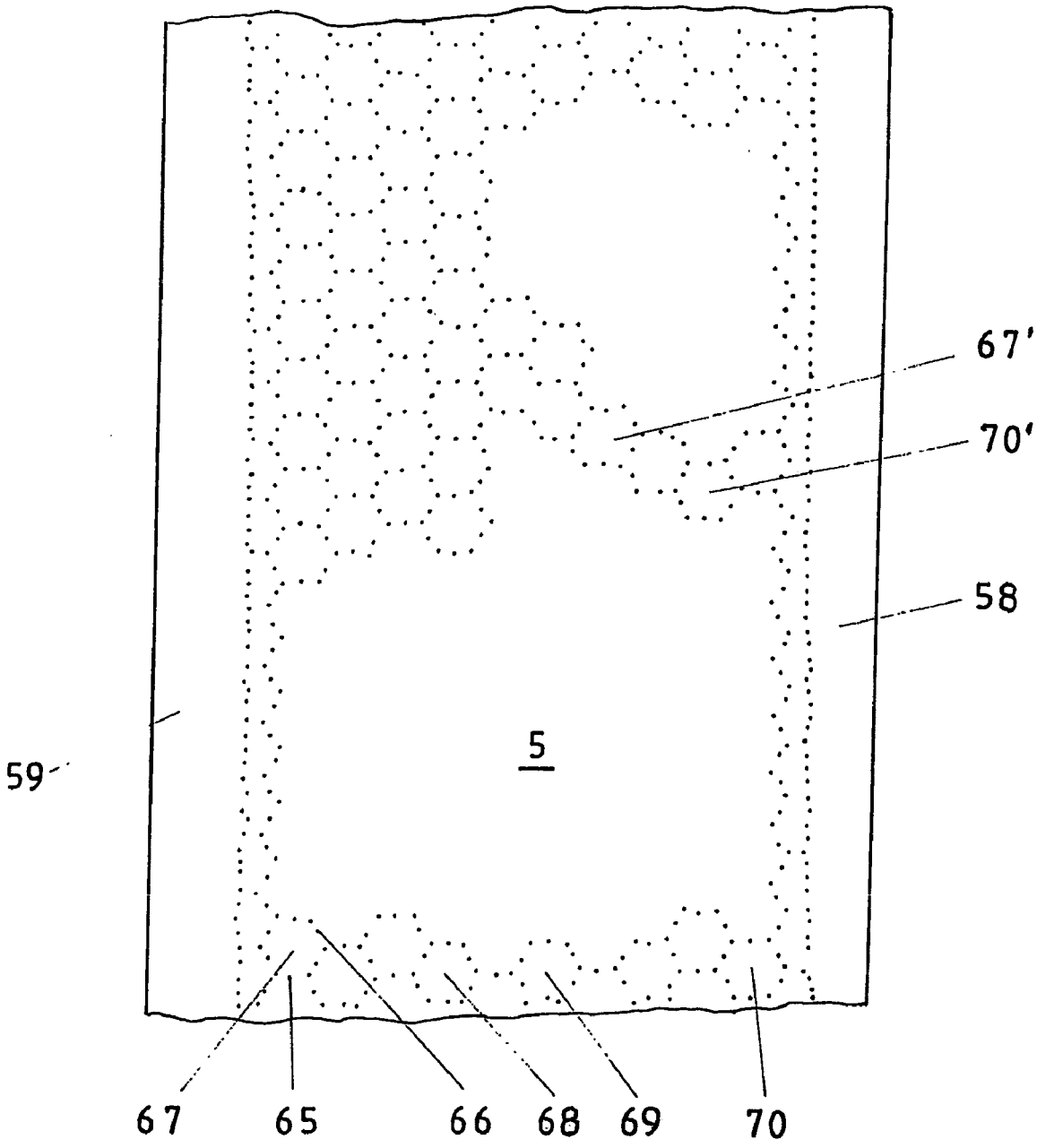

FIG. 8 shows a top view of a moistening roller 10, however, only with a part of the moistening shoes 49, 50, 51. It is evident, however, that a total of six support disks 45, 46, 47 is used, which are configured such that a dry edge 58, 59 remains on both sides, as is indicated in FIG. 14. This is also predetermined by the axis 43 of the moistening roller 10 manifesting spacer disks 44 at the ends, in order to specify ends 57, 57', which can be inserted in the funnel-shaped recesses 42 on the inside 41 of the side walls 40 and ensure a smooth function of the entire moistening roller 10. The individual support disks 45, 46, 47 manifest an outer edge 48, on which the moistening shoes 49, 50, 51 are placed over the bar 60. The support disks 45, 46, 47 are equipped in the center with hollow shafts 52, 52'. They are pushed over the shafts 43 and then inserted in each other, for which purpose they manifest connecting parts 53 and insertion tapers 54. The insertion end 54 has a total of four guide bars 55, 56, which are inserted into corresponding notches shown in FIG. 11, so that the individual support disks 45, 46, 47 can be so connected to each other as to avoid twisting. The deflection rod 15, which has been mentioned several times above, is shown in a top view in FIG. 9, whereby it is apparent, that it is so configured at both rod ends 35, 35', that it can be inserted securely through the insertion opening 36 of the slot-shaped recess 16. The insertion opening 36, as is shown in FIG. 10, then clearly widens into a guide chamber 37, the top 38 of which is inclined in such a manner, that the entire deflection rod 15 remains in the guide chamber 37, even when the end of the sheet 4, 5 or 6 is lifted up too much on one or the other side of the deflection rod 15. This reliably prevents the accidental removal of the deflection rod 15 from the slot-shaped recess 16. FIG. 10 furthermore shows that the slot-shaped recess 16 has a funnel-shaped insertion opening 36 so as to facilitate the insertion of the deflection rod 15 and/or the rod ends 35. FIG. 10 also shows again the flatter insertion taper 31, the trough 32 and the steeper removal taper 33 as well as the funnel-shaped recess 42 on the inside 41 of the side walls 40.

Figure 11:
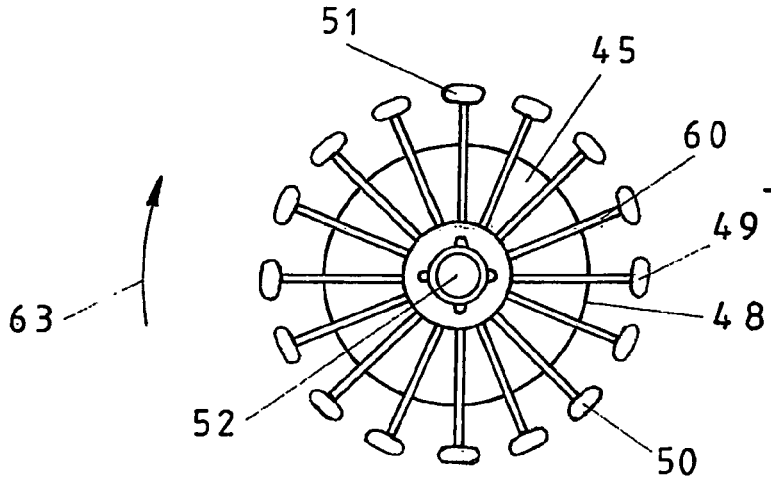
Figure 12:
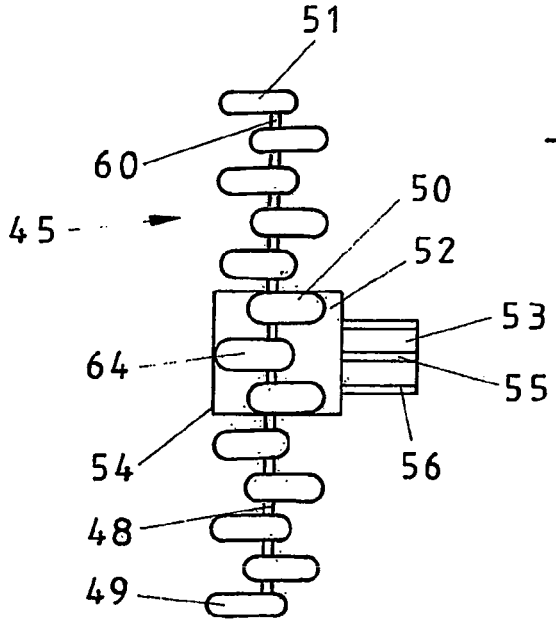

FIG. 11 and FIG. 12 illustrate a side view and a top view of an individual support disk 45, whereby it is clear, that a number of moistening shoes 49, 50, 51 are arranged at a distance from the outside edge 48 of the respective support disk 45. Bars 60 are used to connect them. The special shape of these moistening shoes 49, 50, 51 is shown in FIGS. 6 and 7, so that a detailed illustration can be foregone here. They are only hinted at here. FIG. 12 furthermore shows, that the moistening shoes 49, 50, 51 are alternately arranged to the left of the respective support disk 45 or to the right thereof. This produces an optimal and equal moistening pattern. This will be addressed further below.

FIG. 11 shows the insertion end 54, which can be inserted into the connecting part 53 of the adjacent support disks 46 or 47. The guide bars 55, 56 then ensure a connection without twisting, guaranteeing an equal rotation of the entire moistening roller 10 in the tank 9.

Figure 13:
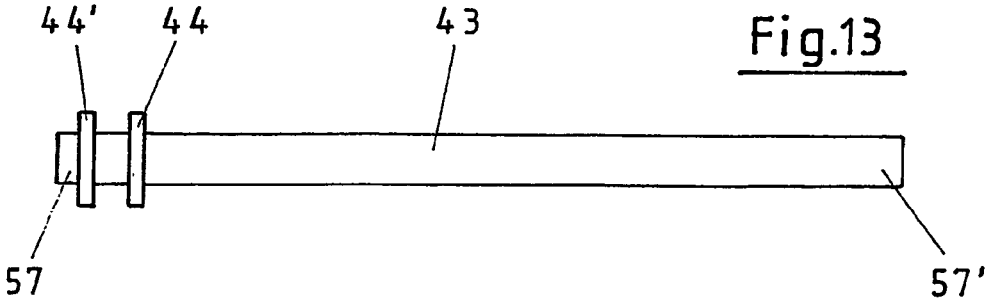

FIG. 13 shows again the axis 43 of the moistening roller 10, wherein the end 57, 57' can be placed or inserted in the funnel-shaped recess 42. It also shows the two spacer disks 44, 44', which ensure, that an equally wide distance remains on the two sides of the moistening roller 10 which distance guarantees a dry edge 58, 59, and together with the dry zones 65, 66 which were not mentioned yet, ensure, that the tensile strength of the individual sheets 4, 5, 6 is maintained even in the moistened state.

FIG. 14 shows a honeycomb-like pattern, however, which is not evident from the illustrations of the support disks 45, 46, 47 and the moistening shoes 49, 50, 51. This can be achieved through the appropriate configuration of the moistening shoes 49, 50, 51, whereby this shape offers the advantage, that the dry zones 65, 66 and the interposed moistening surfaces 67, 68, 69, 70 define the required tensile stability or tensile strength of the sheets 4, 5, 6. The moistening roller 10 is rotated in the direction of motion 63 and ensures that the surfaces 64 of the individual moistening shoes 49, 50, 51 come in contact with the sheets 4, 5, 6 such that either the moistening pattern shown in FIG. 14 or a different one that corresponds to a different moistening shoe is produced.

FIGS. 15 and 16 illustrate a special shape of the moistening shoes, whereby larger or smaller impressions 76, 77, 77' are provided in the surface 64 of the moistening shoes 49, 50, 51 and the impressions have a concave configuration. These impressions 76, 77, 77' provide "containers" in which the moistening shoes 49, 50, 51 can entrain smaller or larger drops, which can then be easily and reliably transferred onto the sheets 4, 5, 6 that pass by.

The moistening shoes 49, 50, 51 shown in FIGS. 15 and 16 are furthermore thereby characterized by they are made of rubber and/or rubber-like material, preferably of a mixture of PE and rubber, so that in addition to the moisture-friendly configuration they also offer the effect of ensuring the entrainment of the sheet 4, 5, 6 guided over them. The rubber-like effects mean a secure carrying along of the individual moistening shoes 49, 50, 51 and hence of the entire moistening roller 10.

Figure 9:
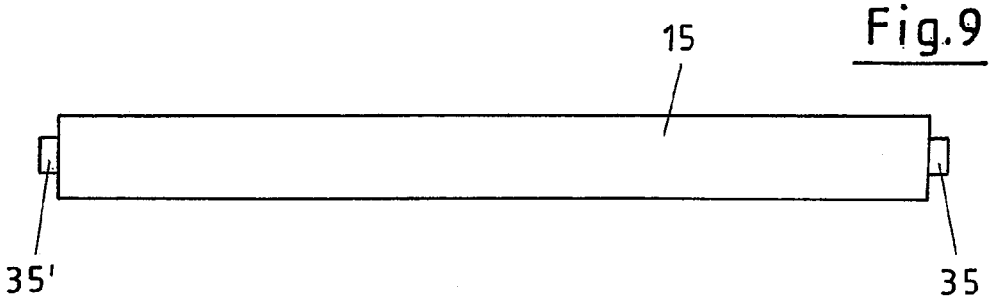
Figure 10:
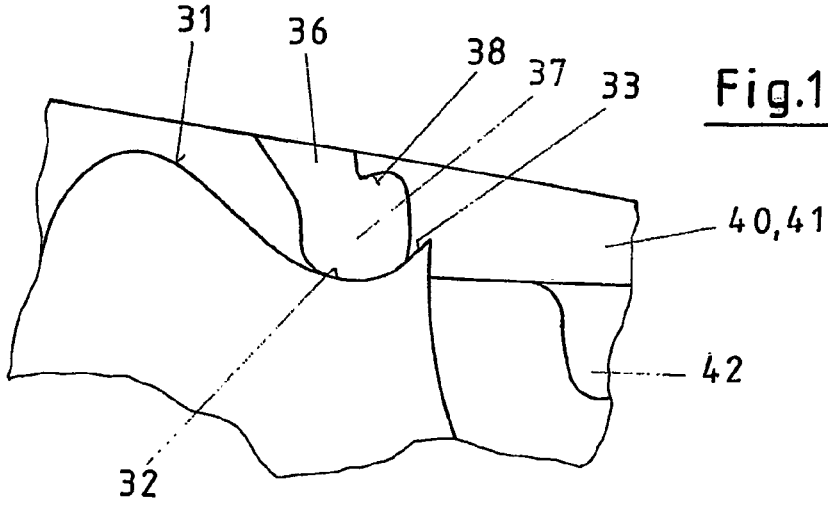

Contrary to the illustration according to FIG. 9, FIG. 17 shows a special configuration of the rod ends 35. FIG. 17 illustrates, that a multi-edge configuration has been selected, which is shown in detail in FIG. 18 on the right. The left illustration has been assigned reference numeral 35" and shows an oval shape of the rod ends 35.

In accordance with the two shapes, the slot-shaped recess 16 and/or the guide chamber 27 have also been selected correspondingly. This is shown in FIG. 19. The guide chamber 37 is shaped such that it is particularly suited for the variant according to FIG. 18 on the right side. It shows that the insertion opening 36 is a downwardly tapered slot, while the subsequent guide chamber 37 is wider at the bottom and narrower at the top, meaning it is tapered towards the top 38. The insertion tapers 74, 75 are shaped accordingly, whereby it can be seen at number 74, that the projecting hook is pointy, in order to facilitate the insertion of the rod ends 35. The version shown in FIG. 19 ensures a reliable placement of the rod end 35 according to FIG. 18 on the right, so that the entire deflection rod 15 can no longer rotate and thus ensures a reliable production of friction.

Figure 20:
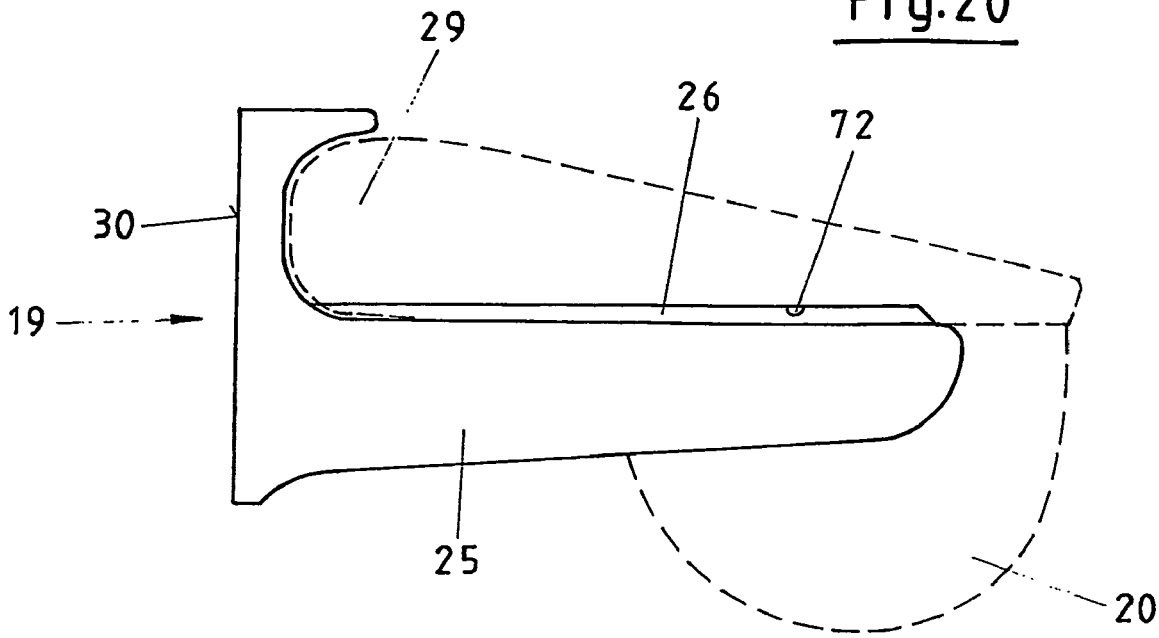
Figure 21:
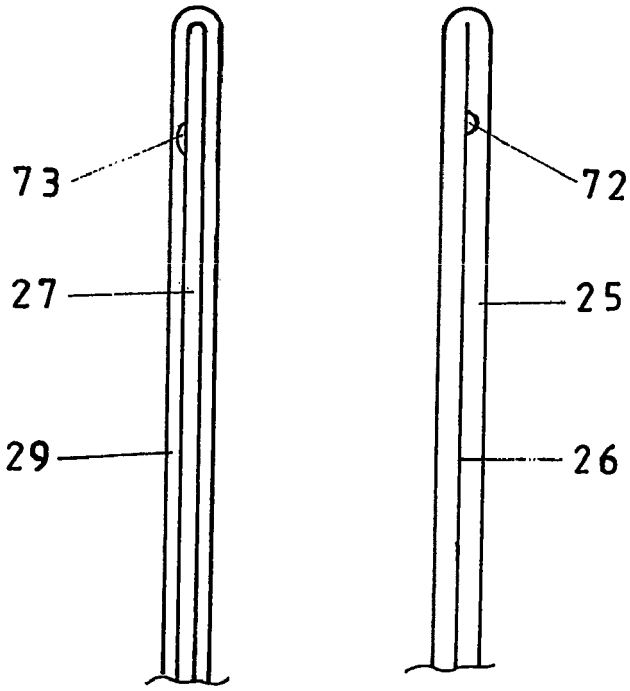

FIGS. 3 and 4 show a tongue-and-groove connection, which has been further developed according to the model shown in FIGS. 20 and 21 to the extent, that the tongue 26 and of course also the groove 27 have a wide design and additionally have a lateral catch point 72 and a corresponding catch groove 73. As the tank part 20 is placed on the support arm 25, the catch point 72 is thus reliably engaged in the catch groove 73, which indicates to the user that the connection has been securely established.

All above characteristics, including those revealed solely in the drawings, are considered essential for the invention, either alone or in combination with each other.

The invention claimed is:

1. A paper moistening device for the storage and specific dispensing of dry or moistened cleaning paper (2), which consists of detachably connected sheets (4, 5, 6) stored on a roller (3), which can be guided with or without the carrying along of the moistening roller (10) associated with a tank (9) over said roller, whereby the rotatable moistening roller (10) and the conductor elements (11) guiding the sheets (4, 5, 6) are associated with a housing (8) that can be connected to the room wall (12), thereby characterized by the housing (8) being arranged on the room wall at a defined distance to the roller (3) with the sheets (4, 5, 6) and by a stationary, funnel-shaped insertion trough (14) and a deflection rod (15) arranged therein, which is secured against accidental removal and guided in a slot-shaped recess (16) allowing substantially vertical movements, being provided as the conductor elements (11), between which the attached sheets (4, 5, 6) can be moved towards the moistening roller (10).

2. A paper moistening device according to claim 1, thereby characterized by the roller (3), together with the sheets (4, 5, 6), forming a unit (17) that is connected above or below the housing (8) and separately to the room wall (12), while the housing (8) with the conductor elements (11) and the moistening roller (10) form another unit (18).

3. A paper moistening device according to claim 1, thereby characterized by the housing (8) being constructed as two parts and manifesting a wall fastening part (19) and a tank part (20) with the conductor elements (11), the tank (9) and the moistening roller (10).

4. A paper moistening device according to claim 1, thereby characterized by the wall fastening part (19) being associated with distancing hooks (21, 22) that can be engaged in the roller (3), which hooks are detachably connected to the wall fastening part (19).

5. A paper moistening device according to claim 1, thereby characterized by the distancing hooks (21, 22) being configured in such a manner, that they can be hinged in the axis of rotation (24) of the roller (3).

6. A paper moistening device according to claim 1, thereby characterized by the wall fastening part (19) including support arms (25), which are designed to simultaneously fix the tank part (20) in place.

7. A paper moistening device according to claim 1, thereby characterized by the support arms (25) and the support part (20) having appropriately configured tongue-and-groove connections (26).

8. A paper moistening device according to claim 1, thereby characterized by the tongue (26) being provided with a lateral catch point (72) and the groove (27) with a corresponding catch groove (73).

9. A paper moistening device according to claim 1, thereby characterized by the insertion trough (14), viewed from the room wall side (30), manifesting a flatter insertion taper (31) with a 20°-60° incline, the actual trough (32) and the removal taper (33), which is steeper towards the opposite side, extending at angles of 70°-85°.

10. A paper moistening device according to claim 1, thereby characterized by the deflection rod (15) manifesting at their end side rod ends (35), which are guided in the slot-shaped recess (16) and which have diameters that correspond to the width of the insertion opening (36) of the slot-shaped recess (16).

11. A paper moistening device according to claim 1, thereby characterized by the deflection rod (15) being positioned in the guide chamber (37) so as not to twist, whereby the rod ends (35) are preferably constructed in a non-circular or in a polygonal, preferably in a square, fashion.

12. A paper moistening device according to claim 1, thereby characterized by the slot-shaped recess (16) being configured as a double funnel (36, 37), which consists of an insertion opening (36) that is open at the top and a subsequent guide chamber, which is open at the bottom and closed at the top.

13. A paper moistening device according to claim 1, thereby characterized by the top (38) of the guide chamber (37) having a slight incline away from the room wall side (37), preferably even extending diagonally upward, while the insertion tapers (74, 75) form a funnel leading up to the top (38), the shape of which funnel has been adapted on one side to the shape of the rod ends (35).

14. A paper moistening device according to claim 1, thereby characterized by the tank (9) of the tank part (20) manifesting a funnel-shaped recess (42) on the inside (41) of the side walls (40), in which recess the shaft (43) of the moistening roller (10) is positioned so as to rotate.

15. A paper moistening device according to claim 1, thereby characterized by the moistening roller (10) manifesting support disks (45, 46, 47) associated with each other at a distance, which disks are provided on the outer edges (48) with moistening shoes (49, 50, 51) and in the center with a hollow shaft (52), which can be slid on the shaft (43).

16. A paper moistening device according to claim 1, thereby characterized by the hollow shafts (52) of the support disks (45, 46, 47) being configured such that they can be connected to the adjacent hollow shafts (52') without twisting.

17. A paper moistening device according to claim 1, thereby characterized by the support disks (45, 46, 47) with the moistening shoes (49, 50, 51) being arranged on the shaft (43) while maintaining dry edges (58, 59) on both sides of the sheets (4, 5, 6) or by the outer support disks (45', 46') being positioned at a defined distance to the side walls (40).

18. A paper moistening device according to claim 1, thereby characterized by the moistening shoes (49, 50, 51)

being connected to the support disks (45, 46, 47) offset from the center and in a manner alternating to both sides.

19. A paper moistening device according to claim 1, thereby characterized by the moistening shoes (49, 50, 51) being connected to the support disk (45, 46, 47) via a bar (6) dimensioned in accordance with the width of the support disk (45, 46, 47).

20. A paper moistening device according to claim 1, thereby characterized by the moistening shoes (49, 50, 51) having rounded or sharp edges (61, 62).

21. A paper moistening device according to claim 1, thereby characterized by the moistening shoes (49, 50, 51) being constructed in a hull-like manner in the direction of movement (63).

22. A paper moistening device according to claim 1, thereby characterized by the moistening shoes (49, 50, 51) being made of rubber and/or rubber-like material (PE+rubber) and/or manifesting one or several concave impressions (76, 77) in the surfaces (64) thereof.

23. A paper moistening device according to claim 1, thereby characterized by the moistening shoes (49, 50, 51) or the bars (60) being detachably connected to the support disks (45, 46, 47), preferably inserted in bore holes of the support disks (45, 46,47), or being configured such that they can be placed on the support disks (45, 46, 47).

24. A paper moistening device according to claim 1, thereby characterized by the moistening shoes (49, 50, 51) being constructed in a tapered, hull-like manner all the way around.

25. A paper moistening device according to claim 1, thereby characterized by the moistening shoes (49, 50, 51) being constructed and/or positioned in a honeycomb-like manner.

26. A paper moistening device according to claim 1, thereby characterized by the moistening shoes (49, 50, 51) being configured like large honeycomb walls, leaving some narrow dry zones (65, 66) between them.

27. A paper moistening device according to claim 1, thereby characterized by the dry zones (65, 66) manifesting widths of from 0.5 to 5.0 mm, preferably 2.0 mm.

28. A paper moistening device according to claim 1, thereby characterized by the deflection rod (15) having a rough surface design or manifesting an appropriate coating or being made of the same material as the moistening shoes (49, 50, 51).

* * * * *